US011807340B2

(12) United States Patent
D'Urso

(10) Patent No.: US 11,807,340 B2
(45) Date of Patent: Nov. 7, 2023

(54) FUEL TANK ARRANGEMENT IN A MARINE VESSEL

(71) Applicant: WÄRTSILÄ FINLAND OY, Vaasa (FI)

(72) Inventor: Emanuele D'Urso, Trieste (IT)

(73) Assignee: WÄRTSILÄ FINLAND OY, Vaasa (FI)

( * ) Notice: Subject to any disclaimer, the term of this patent is extended or adjusted under 35 U.S.C. 154(b) by 913 days.

(21) Appl. No.: 16/531,496

(22) Filed: Aug. 5, 2019

(65) Prior Publication Data

US 2020/0047852 A1 Feb. 13, 2020

Related U.S. Application Data

(63) Continuation of application No. PCT/EP2017/052526, filed on Feb. 6, 2017.

(51) Int. Cl.
*F17C 3/06* (2006.01)
*B63B 17/00* (2006.01)

(52) U.S. Cl.
CPC ..... *B63B 17/0027* (2013.01); *F17C 3/06* (2013.01); *F17C 2201/0109* (2013.01); *F17C 2201/035* (2013.01); *F17C 2203/03* (2013.01); *F17C 2203/0629* (2013.01); *F17C 2205/0332* (2013.01); *F17C 2223/0161* (2013.01); *F17C 2223/033* (2013.01);
(Continued)

(58) Field of Classification Search
CPC ..... B63B 17/0027; F17C 3/025; F17C 3/06; F17C 2203/03; F17C 2223/0161
See application file for complete search history.

(56) References Cited

U.S. PATENT DOCUMENTS 2,871,669 A * 2/1959 Mann ..... F17C 3/10 62/157
RE25,065 E * 10/1961 Daley et al.
(Continued)

FOREIGN PATENT DOCUMENTS

WO 9423201 A2 10/1994
WO 2013128063 A1 9/2013
WO 2016097460 A1 6/2016

OTHER PUBLICATIONS

International Search Report (PCT/ISA/210) dated Jan. 22, 2018, by the European Patent Office as the International Searching Authority for International Application No. PCT/EP2017/052526.
(Continued)

*Primary Examiner* — Stephen J Castellano
(74) *Attorney, Agent, or Firm* — BUCHANAN, INGERSOLL & ROONEY PC

(57) ABSTRACT

A fuel tank arrangement of a marine vessel is disclosed, having an LNG-fuel tank formed of an inner shell, an outer shell, an insulation therebetween and a tank connection space provided at an end of the LNG-fuel tank, the inner shell having an end part at an end of the inner shell facing the tank connection space. A collar is fastened to the end part of the inner shell and extends conically outwardly from the inner shell. The collar has an outer rim to which an additional shell extending in an axial direction away from the inner shell is fastened, and the additional shell has an end rim opposite the collar to which an end cover of the tank connection space is fastened.

11 Claims, 3 Drawing Sheets

- LNG-fuel tank 12 includes: tank inner shell 20 which encloses a storage space for LNG-fuel; tank outer shell 22; LNG-fuel tank insulation 24 therebetween; collar 28
- Tank outer shell 22 has a tank outer shell end cover 22' positioned at an axial end of the LNG-fuel tank 12
- Collar 28 has a collar inner rim and a collar outer rim, collar inner rim being fastened to the tank inner shell 20
- Tank connection space 26 is separate and distinct from storage space for LNG-fuel
- Tank connection space 26 has connection space shell insulation thereon facing away from tank connection space 26 and having a thickness of less than half of that of the LNG-fuel tank insulation 24

(52) U.S. Cl.
CPC ..... *F17C 2227/0135* (2013.01); *F17C 2227/0178* (2013.01); *F17C 2270/0105* (2013.01)

(56) References Cited

U.S. PATENT DOCUMENTS

| | | | | |
|---|---|---|---|---|
| 5,411,374 | A | 5/1995 | Gram | |
| 5,477,690 | A | 12/1995 | Gram | |
| 5,551,488 | A | 9/1996 | Gram | |
| 2016/0084441 | A1* | 3/2016 | Fauvel | F17C 7/04 62/50.2 |
| 2017/0343159 | A1 | 11/2017 | Råholm et al. | |
| 2018/0266628 | A1* | 9/2018 | Karlsson | F17C 13/004 |
| 2019/0285273 | A1* | 9/2019 | Kuchiki | B63H 21/38 |

OTHER PUBLICATIONS

Written Opinion (PCT/ISA/237) dated Jan. 22, 2018, by the European Patent Office as the International Searching Authority for International Application No. PCT/EP2017/052526.

* cited by examiner

- LNG-fuel tank 12 includes: tank inner shell 20 which encloses a storage space for LNG-fuel; tank outer shell 22; LNG-fuel tank insulation 24 therebetween; collar 28
- Tank outer shell 22 has a tank outer shell end cover 22' positioned at an axial end of the LNG-fuel tank 12
- Collar 28 has a collar inner rim and a collar outer rim, collar inner rim being fastened to the tank inner shell 20
- Tank connection space 26 is separate and distinct from storage space for LNG-fuel
- Tank connection space 26 has connection space shell insulation thereon facing away from tank connection space 26 and having a thickness of less than half of that of the LNG-fuel tank insulation 24

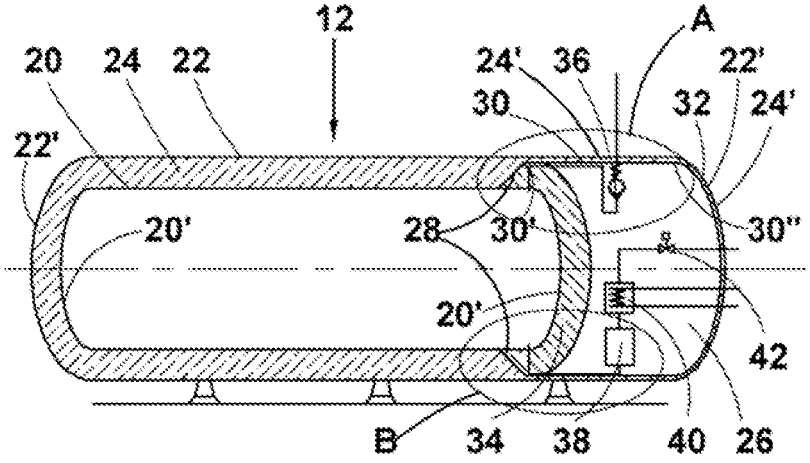

Fig. 2

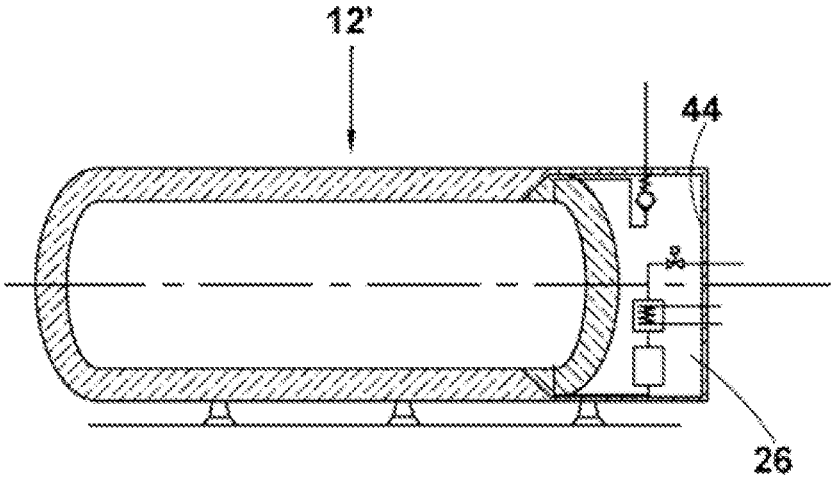

Fig. 3

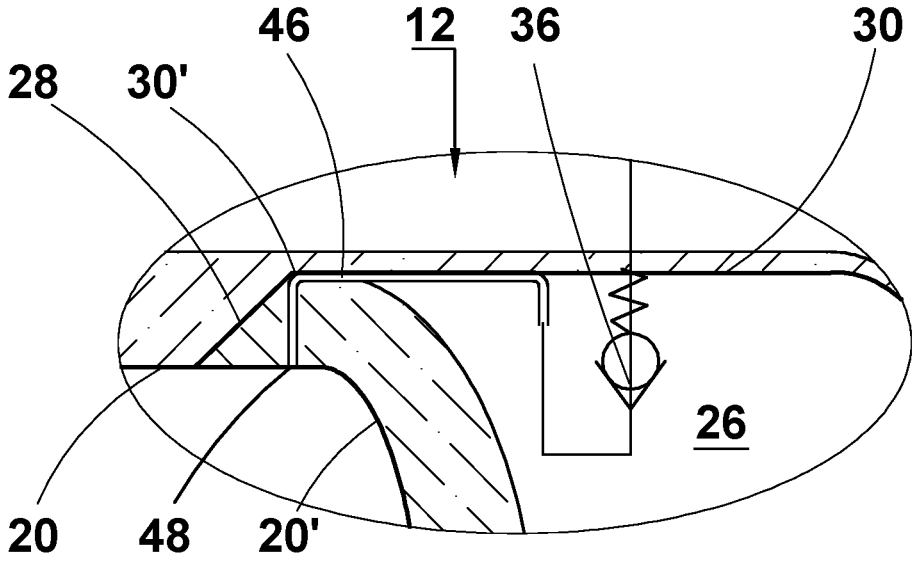
Fig. 4a (Det. A)
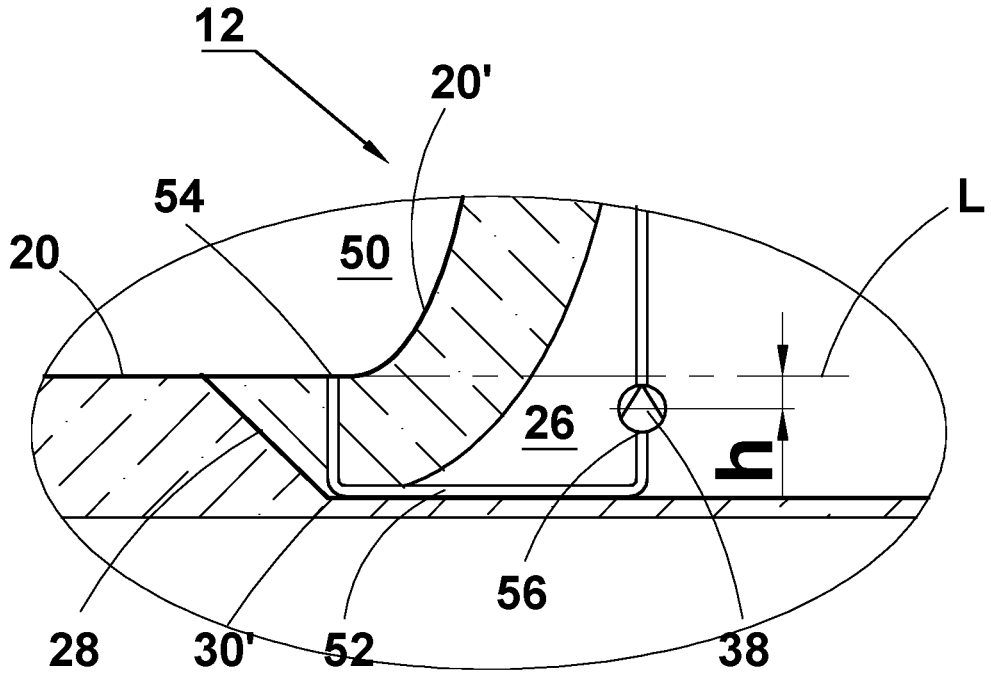
Fig. 4b (Det. B)

FUEL TANK ARRANGEMENT IN A MARINE VESSEL

RELATED APPLICATION

This application claims priority as a continuation application under 35 U.S.C. § 120 to PCT/EP2017/052526 filed as an International Application on Feb. 6, 2017 designating the U.S., the entire content of which is hereby incorporated by reference in its entirety.

FIELD

The present disclosure relates to a fuel tank arrangement in a marine vessel for storing LNG-fuel. For example, the present disclosure relates to such an LNG-fuel tank arrangement where the tank includes an inner shell, an outer shell and a tank connection space arranged at an end of the LNG-fuel tank.

BACKGROUND INFORMATION

The use of LNG (Liquefied Natural Gas) as fuel for marine applications is increasing since it is an efficient way of cutting emissions. Within the next few decades, natural gas (NG) is expected to become the world's fastest growing major energy source. The driving forces behind this development are the depleting known oil reserves, increasing environmental care and the continuous tightening of emission restrictions. All major emissions can be significantly reduced to truly form an environmentally sound solution; the reduction in $CO_2$, in particular, is difficult to achieve with conventional oil-based fuels. NG consists of methane ($CH_4$) with minor concentrations of heavier hydro-carbons such as ethane and propane. In normal ambient conditions NG is a gas, but it can be liquefied by cooling it down to −162° C. In liquid form the specific volume is reduced significantly, which allows a reasonable size of storage tanks relative to energy content. The burning process of NG is clean. Its high hydrogen-to-coal ratio (the highest among the fossil fuels) means lower $CO_2$ emissions compared with oil-based fuels. When NG is liquefied, all sulphur is removed, which means zero $SO_x$ emissions. The clean burning properties of NG also significantly reduce $NO_x$ and particle emissions compared with oil-based fuels. Particularly in cruise vessels, ferries and so called ro-pax vessels, where passengers are on board, the absence of soot emissions and visible smoke in the exhaust gases of ship's engines is a very important feature.

LNG is not only an environmentally sound solution, but also economically interesting at today's oil prices. The most feasible way of storing NG in ships is in liquid form. In existing ship installations, LNG is stored in cylindrical, heat insulated single- or double-walled, stainless steel tanks. The tank pressure is defined by a specified requirement of the engines burning the gas and is, for example, less than 5 bar. A higher (for example, 9 bar) tank design pressure can be selected due to the natural boil-off phenomenon.

WO-A1-2013128063 discusses an LNG tank having an inner shell of stainless steel and an outer shell spaced at a distance from the inner shell. The inner and outer shells define an insulation space therebetween. The LNG tank is provided, for emptying the tank, with at least one double-walled pipe of stainless steel connected to the LNG tank, the at least one double-walled pipe having a common outer wall and at least one inner pipe. The outer wall of the pipe is connected to the inner shell of the tank by a bellows-like pipe fitting welded to the outer wall(s) of the pipe(s) and to the inner shell of the tank. The at least one double-walled pipe extends into a tank connection space arranged at an end of the tank. The end of the at least one inner pipe extending into the tank connection space is connected to a valve in a valve block and the end of the outer wall of the pipe extending into the tank connection space is welded to the valve block to provide a continuous secondary barrier for the at least one inner pipe between the inner shell of the tank and the valve block.

The LNG-fuel tanks may be divided in two different types depending on the way the gas is stored or planned to be fed to the engine. If the gas is stored in a pressurized state and fed by pressure in the fuel tank, the tank should be of so-called double wall structure having a stainless steel inner shell designed for internal pressure and an outer shell that acts as a secondary barrier. The heat insulation in double-walled tanks is normally vacuum filled perlite granules. If there is no significant pressure in the fuel tank, the tank may be a single-walled one and the gas feed to the engine is based on the use of a cryogenic pump. In such an LNG-fuel tank the inner shell is stainless steel and the outer shell may be of plastics or fiber reinforced material just for protecting the heat insulation from mechanical abrasion, weather conditions etc. The heat insulation in these tanks is, for example but not necessarily, polyurethane filling the cavity between the inner and the outer shells.

In both LNG-tank types a tank connection space can be provided at one end of the tank. The tank connection space is for example, a known rectangular box-like space housing, depending on the type of the LNG-tank, various valves (the gas valve unit controlling the feed of fuel to the engine and the emergency pressure release valve controlling the pressure in the LNG-fuel tank, just to name a couple valves) and a cryogenic pump (if needed) by which emptying of the tank and fuel introduction to the engine is controlled. However, sometimes the tank connection space is to be pressurized, whereby the use of box-like rectangular structures result in complex constructions.

A further issue concerning the feeding of LNG from a non-pressurized LNG-tank to the engine relates to the use of the cryogenic pump for discharging LNG from the non-pressurized tank and feeding such towards the engine. When a pump is used for transferring a liquid a basic feature of the pump is that the element performing the pumping (for instance a rotor or an impeller) tends to create suction, i.e. an area of reduced pressure in front of the pump is formed. Now that LNG very easily evaporates or boils it has to be ensured that such does not take place in front of the cryogenic pump, which would mean, at least, uncontrolled, unstable pumping or ceasing of the pumping entirely if the evaporation results in the rotation of the rotor in a gas-filled space. The only way to avoid the evaporation is to arrange the liquid level in the LNG-tank high enough above the pump such that the hydrostatic pressure of the fuel exceeds the suction created in front of the cryogenic pump. This has meant in known constructions that the inlet opening to the outlet duct provided in the LNG-fuel tank for the discharge of the fuel has to be positioned to a level significantly above the pump in the tank connection space. This, again, involves a significant volume of the fuel tank being out of efficient use.

SUMMARY

A fuel tank arrangement for a marine vessel for storing LNG-fuel is disclosed, the fuel tank arrangement comprising: an LNG-fuel tank formed of an inner shell, an outer shell, and an insulation therebetween; and a tank connection space provided at an end of the LNG-fuel tank, the tank connection space having an additional end cover fastened to a second end of an additional shell, the additional shell being fastened at its first end to an outer rim of a collar, the collar having an inner rim fastened to the inner shell of the fuel tank, the additional shell extending in an axial direction away from the inner shell.

BRIEF DESCRIPTION OF THE DRAWINGS

In the following, the present invention will be described in more detail with reference to the accompanying exemplary embodiments as illustrated in schematic drawings, in which:

FIG. 2 illustrates schematically a longitudinal cross-section of an exemplary LNG-fuel tank in accordance with a first exemplary embodiment of the present disclosure;

FIG. 3 illustrates schematically a longitudinal cross-section of an exemplary LNG-fuel tank in accordance with a second exemplary embodiment of the present disclosure;

FIG. 4*a* illustrates in an enlarged scale detail A of FIG. 2; and

FIG. 4*b* illustrates in an enlarged scale detail B of FIG. 2.

DETAILED DESCRIPTION

Figure 1:
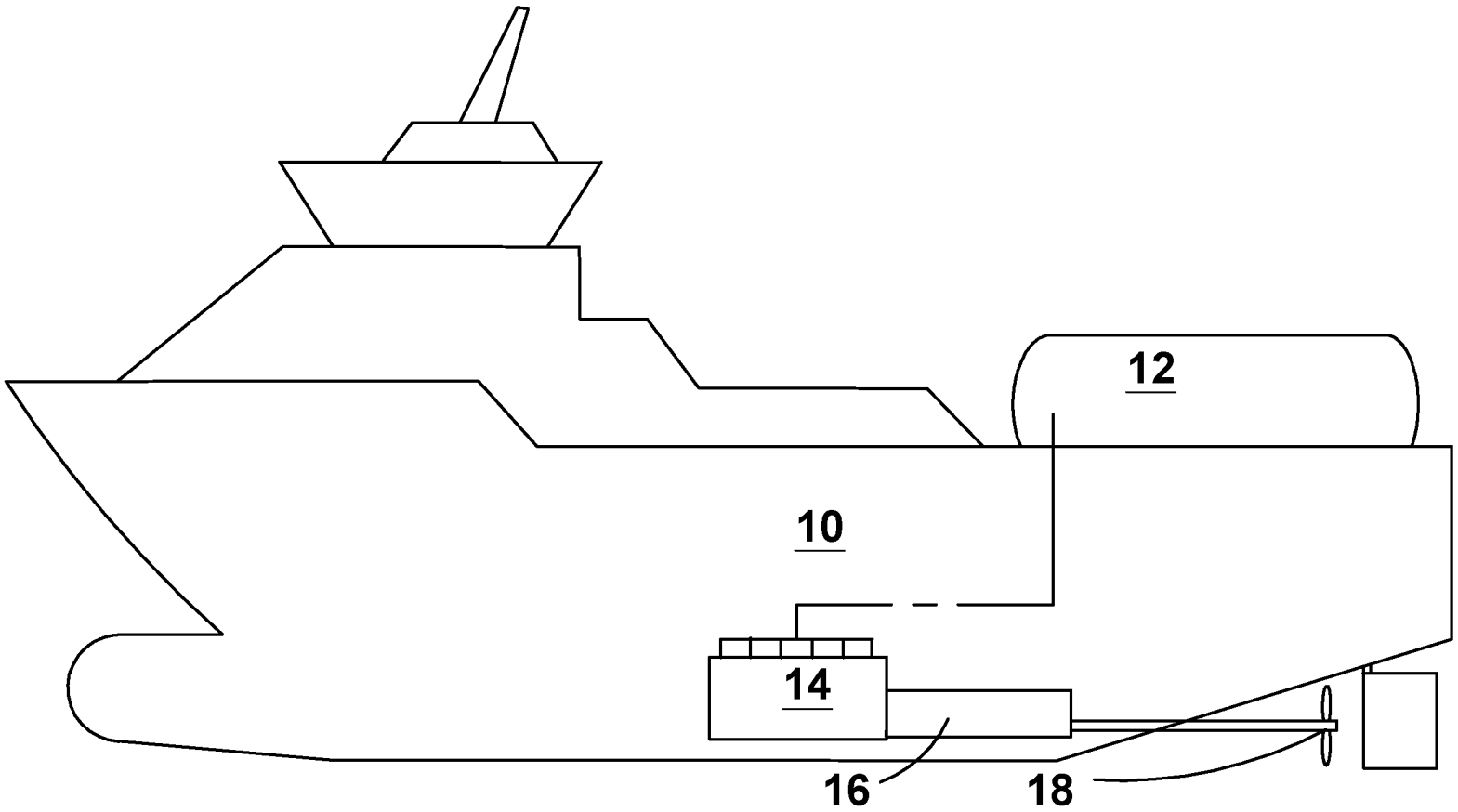
FIG. 1 illustrates schematically a side view of an exemplary marine vessel having an exemplary LNG-fuel tank of the present disclosure on the deck thereof.

An LNG-fuel tank arrangement for a marine vessel is disclosed to address one or more of the above mentioned issues.

An LNG-fuel tank arrangement for a marine vessel is disclosed wherein the use of double walled piping between the fuel tank and the tank connection space can be avoided.

As discussed herein, a novel LNG-fuel tank arrangement is provided where an entire volume of the fuel tank may be taken in efficient use.

A novel LNG-fuel tank arrangement is also disclosed where the use of a box-like tank connection space can be avoided.

A fuel tank arrangement in a marine vessel is disclosed for storing LNG-fuel, the arrangement having an LNG-fuel tank formed of an inner shell, an outer shell, an insulation therebetween and a tank connection space provided at an end of the LNG-fuel tank, the LNG-fuel tank having a top and a bottom, wherein the tank connection space includes an additional end cover fastened to a second end of an additional shell, the additional shell being fastened at its first end to an outer rim of a collar, the collar having an inner rim fastened to the inner shell, and the additional shell extending in an axial direction away from the inner shell.

An exemplary fuel tank arrangement in a marine vessel is disclosed for storing LNG-fuel, the arrangement including an LNG-fuel tank formed of an inner shell, an outer shell, an insulation therebetween and a tank connection space provided at an end of the LNG-fuel tank, the tank connection space housing a cryogenic pump, the cryogenic pump being in communication with the interior of the fuel tank by means of a flow passage, and the LNG-fuel tank having a top and a bottom, wherein the inner shell has an inner surface, an inlet opening to the flow passage is at the bottom of the LNG-fuel tank, and the cryogenic pump has an inlet, the inlet being positioned at a vertical distance h below the bottom, i.e. a level L, of the LNG-fuel tank.

An exemplary fuel tank arrangement of the present disclosure can offer at least some of the following advantages:

a. use of double-walled fuel piping between the LNG-fuel tank and the tank connection space is not needed,
b. taking passages from the interior of the LNG-fuel tank to both the emergency pressure-relief valve and the cryogenic pump inside a pressurized shell—no extra piping or other elements outside the outer shell of the LNG-fuel tank, saves space and reduces both risk of injury and damage to the piping,
c. the entire volume of the LNG-fuel tank may be taken in efficient use, and
d. the LNG tank and the tank connection space form a compact and uniform unit.

FIG. 1 illustrates schematically and in a very simplified manner a marine vessel 10 with an LNG-fuel tank 12 in accordance with a first preferred exemplary embodiment of the present disclosure provided on the deck thereof. Naturally, the LNG-fuel tank may also be positioned below the deck. The Figure shows also the internal combustion engine 14 receiving fuel from the LNG-fuel tank 12 and the drive means 16 coupled to both the engine and the propeller 18. The drive means may here include either a mechanical gear or a generator—electric drive combination.

FIG. 2 illustrates schematically basic construction of the LNG-fuel tank 12 in accordance with a first preferred exemplary embodiment of the present disclosure. The fuel tank 12 is formed of an inner shell 20, an outer shell 22 and a heat insulation 24 therebetween. The inner and outer shells are, for example, not necessarily cylindrical. The inner shell 20 has end covers 20' at both of its ends. Similarly, the outer shell 22 has end covers 22' at both of its ends. The end covers of the inner and outer shells are, for example curved, e.g., dome-shaped, like semi-spherical or semi-ellipsoidal, just to name a couple alternatives. At an end of the fuel tank 12 a so called tank connection space 26 is arranged. In accordance with the present disclosure, for example, but not necessarily, at the end part of the inner shell 20 (e.g., at about a distance of between 2 and 20%, for example between 5 and 15%, of a length of the inner shell 20) facing the tank connection space 26, a collar 28 extends conically outwardly from the inner shell 20 and is fastened via its inner rim, for example by means of welding (e.g., a welded connection), to the outer surface of the inner shell 20. The conical collar 28 extends at a distance to the outer shell 22. e.g., the collar 28 leaves a gap between the outer rim thereof and the outer shell 22. To the radially outer rim of the conical collar 28 is fastened, for example by means of welding (e.g., weld connection) or other suitable connection, an additional shell 30 at its first end 30'. The additional shell forms the inner shell of the tank connection space 26. The additional shell 30 extends in an axial direction away from the inner shell 20, is for example, formed of similar material than the inner shell 20 and has for example a similar thickness with the inner shell 20, too. To the second end 30" of the additional shell 30 opposite the conical collar 2 an additional end cover 32 of the tank connection space 26 is fastened, for example by welding or other suitable connection. The collar 28, the additional shell 30 and the additional end cover 32 form together with the end cover 20' of the inner shell 20 a pressurized gas tight cavity, e.g., the tank connection space 26, configured for a pressure of about 0.3-1 bar above atmospheric pressure.

The end 20' of the inner shell 20 facing the tank connection space 26 is provided with heat insulation 34 having a dimension almost as thick as the insulation 24 on the other parts of the inner shell 20. The insulation 24 continues as a thinner insulation 24' round the tank connection space 26, e.g., between the outer shell 22 and the additional shell 30 as well as between the additional end cover 32 of the tank connection space 26 and the end cover 22' of the outer shell. The thickness of the insulation 24' is less than half;

for example less than 20%, of that of the insulation 24 between the inner shell 20 and the outer shell 22. Thus, the outer shell 22 encloses both the inner shell and the tank connection space 26 by having the same cross-sectional shape and size for the entire length thereof.

The exemplary tank connection space 26 houses an emergency pressure relief valve 36, which opens a vent connection from the top of the tank 12 to the vent mast in case pressure in the tank exceeds a predetermined value. The tank connection space 26 also houses a cryogenic pump 38 for providing the engine with the fuel it needs, an evaporator 40 for evaporating the liquid fuel to gaseous state, and a fuel valve unit 42 for controlling the gas feed to the engine.

FIG. 3 illustrates schematically a basic exemplary construction of an LNG-tank 12' in accordance with a second exemplary preferred embodiment of the present disclosure. The only difference compared to FIG. 2 is the end cover 44 of the tank connection space 26, which is, in this embodiment, flat. In other words, the shape of the end cover of the tank connection space 26 may be freely chosen, though the dome-shape (of FIG. 2) similar to the opposite end of the fuel tank 12' is a desired, but not necessary, one. When designing and configuring the end cover, naturally, the expected pressure conditions in the tank connection space can be taken into account. It means, for instance, that the thickness of a flat cover needs to be bigger than if the cover were dome-shaped. The rest of the components of the LNG-fuel tank 12' and the tank connection space 26 can be the same as in FIG. 2.

FIG. 4*a* illustrates detail A, i.e. an enlarged partial cross sectional side view of the LNG-tank of FIG. 2 having a tank connection space 26 at an end thereof. The Figure illustrates the upper part of the tank connection space 26 having the emergency pressure relief valve 36. The Figure also shows the conical collar 28 fastened to the inner shell 20, and the additional shell 30 of the tank connection space 26 fastened at its first end 30' to the outer rim of the collar. The passage 46 leading from the LNG-fuel tank 12 to the emergency pressure relief valve 36 and further out of the tank connection space 20 to the vent mast opens in the uppermost surface of the inner shell 14 of the LNG-tank, e.g., to the top of the LNG-fuel tank, such that the opening 48 in the inner shell 20 into the passage 46 is flush with the inner surface of the inner shell 20 at the top of the LNG-fuel tank 12. By the above described arrangement it can be ensured that, in practice, all gas may be removed from the tank 12 until liquid is able to enter the passage 46.

FIG. 4*b* illustrates detail B, i.e. an enlarged partial cross sectional side view of the LNG-tank 12 of FIG. 2 having a tank connection space 26 at an end thereof. The Figure shows the cryogenic pump 38 used for providing fuel from the interior 50 of the fuel tank 12 for the internal combustion engine. The pump 38 is arranged in communication with the fuel tank interior 50 by means of an inlet passage 52 having an inlet opening 54 in the lowermost position in the wall of the inner shell 20, e.g., at the bottom of the LNG-fuel tank 12. The inlet opening 54 is flush with the inner surface of the inner shell 20. The inlet passage 52 takes the fuel downwardly and passes the fuel to the inlet 56 of the cryogenic pump 38.

FIG. 4*b* also shows how the cryogenic pump 38 is arranged below the level L of the bottom, or lowermost surface of the fuel tank interior 50. To be more specific, if, for instance, it is a question of a centrifugal pump installed with its axis vertically, the impeller eye thereof has to be at or, for example, below the level L. By the impeller eye is understood the point in the impeller, where the axial fluid flow is turned into more or less radial flow. In case the centrifugal pump is installed with its axis horizontally, the inlet duct to the pump should be, over its entire diameter, below the level L. A purpose for this kind of an arrangement is to prevent the evaporation of the fuel upstream of the pump, i.e. mostly due to suction of the pump. If the fuel starts to evaporate the operation of the pump is not stable and the fuel delivery to the engine is compromised. Now, by arranging the fuel pump 38 below the lowest possible fuel surface in the tank interior 50, e.g., below the bottom level L of the tank 12, a certain positive pressure is ensured in the inlet 56 (meaning either the inlet eye or the inlet duct when the cryogenic pump is a centrifugal pump) of the cryogenic pump 38, such that the fuel flows in the pump 38 by mere hydrostatic pressure. If and when it is needed or desired to take into account pressure loss occurring in the inlet passage 52 and in the pump itself, the vertical distance h between the pump inlet 56 and the level L can be dimensioned accordingly, e.g., increasing the distance h the higher the pressure losses are.

The above collar has been described as a conical one. However, it should be understood that the conical shape of the collar is just an exemplary alternative. The collar may also be annular radial plate or any suitable shape. However, that the collar can for example be in an inclined position in relation to the inner shell, e.g., a cone, or formed of two or more conical sections in the manner of a bellows, or the collar may have a curved cross section, e.g., the shape thereof being, for instance, a quarter of a torus or a quarter of an ellipsoid, or other suitable shape.

While the invention has been described herein by way of examples in connection with what are, at present, considered to be preferred exemplary embodiments, it is to be understood that the invention is not limited to the disclosed embodiments, but is intended to cover various combinations or modifications of its features, and several other applications included within the scope of the disclosure. It should be understood that the tank arrangement can include several features which are not shown in figures for the sake of clarity, for example, all such equipment present in each tank arrangement that concern fuel handling has been left out, as the present invention is not directed to fuel handling but to the manhole construction. The details mentioned in connection with any embodiment above may be used in connection with any other embodiment when such combination is technically feasible, as will the approach to those skilled in the art.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A fuel tank arrangement for a marine vessel for storing LNG-fuel, the fuel tank arrangement comprising:

an LNG-fuel tank;

the LNG-fuel tank including a tank inner shell which encloses a storage space for LNG-fuel, a tank outer shell, LNG-fuel tank insulation therebetween, and a collar; and the tank outer shell has a tank outer shell end cover positioned at an axial end of the LNG-fuel tank; the collar has a collar inner rim and a collar outer rim, the collar inner rim being fastened to the tank inner shell;

a tank connection space;

the tank connection space includes a pressurized gas tight cavity formed by:

a connection space shell;

a connection space end cover; and the tank outer shell end cover;

connection space shell insulation facing away from the tank connection space and having a thickness of less than half of that of the LNG-fuel tank insulation;

wherein the tank connection space is separate and distinct from the storage space for LNG-fuel;

wherein the collar is positioned between the tank inner shell and a tank inner shell end cover;

wherein the LNG-fuel tank is configured for containing fuel; and wherein the tank connection space is configured for containing equipment.

2. The fuel tank arrangement as recited in claim 1, further comprising:

an inlet opening at a surface of the LNG-fuel tank, the inlet opening being in communication with a cryogenic pump by a flow passage.

3. The fuel tank arrangement as recited in claim 2, wherein the cryogenic pump comprises:

an inlet being positioned vertically below the surface of the LNG-fuel tank.

4. The fuel tank arrangement as recited in claim 2, wherein the cryogenic pump is in the tank connection space.

5. The fuel tank arrangement as recited in claim 1, further comprising:

an emergency pressure relief valve in the tank connection space; and a passage connecting the emergency pressure relief valve to an outlet opening at an inner surface of the LNG-fuel tank.

6. The fuel tank arrangement as recited in claim 5, wherein the tank inner shell comprises:

an inner surface, the outlet opening, and an inlet opening, the inlet opening being flush with the inner surface, the inlet opening being in communication with a cryogenic pump by a flow passage.

7. The fuel tank arrangement as recited in claim 1, wherein the LNG-fuel tank is cylindrical.

8. The fuel tank arrangement as recited in claim 1, wherein the connection space end cover is dome-shaped or flat.

9. The fuel tank arrangement as recited in claim 1, wherein the tank inner shell end cover is a dome-shaped end cover facing the tank connection space.

10. The fuel tank arrangement as recited in claim 1, wherein the connection space shell is cylindrical.

11. The fuel tank arrangement as recited in claim 1, wherein the collar extends outwardly from the tank inner shell and has an inclined, conical, bellows-shaped or curved profile when cross sectioned.

* * * * *